US005570071A

United States Patent [19]

Ervasti

[11] Patent Number: 5,570,071

[45] Date of Patent: Oct. 29, 1996

[54] SUPPORTING OF A HELIX RESONATOR

[75] Inventor: Kimmo A. Ervasti, Oulunsalo, Finland

[73] Assignee: LK-Products Oy, Kempele, Finland

[21] Appl. No.: 146,037

[22] Filed: Oct. 23, 1992

Related U.S. Application Data

[63] Continuation of PCT/FI91/00141 published as WO91/17583 Nov. 14, 1991.

[30] Foreign Application Priority Data

May 4, 1990 [FI] Finland ..... 902264

[51] Int. Cl.[6] ..... H01P 7/00

[52] U.S. Cl. ..... 333/219; 333/202

[58] Field of Search ..... 333/219, 202–205, 333/235

[56] References Cited

U.S. PATENT DOCUMENTS 3,936,776 2/1976 Sundquist ..... 333/202

4,977,383 12/1990 Niiranen ..... 333/219

5,159,303 10/1992 Flink ..... 333/219

5,418,508 5/1995 Puurunen ..... 333/202

*Primary Examiner*—Benny Lee

*Assistant Examiner*—Darius Gambino

*Attorney, Agent, or Firm*—Darby & Darby, P.C.

[57] ABSTRACT

In the mechanical supporting of the resonator coil it is known to use around the resonator coil an injection moulded plastic U-shaped binder ring, with the loops of the coil running through the arms in the binder ring. The resonator wire can also be wound around a plastic body. The methods of the prior art considerably weaken the Q value of the resonator. According to the invention it is possible to achieve good supporting, without a weakening of the Q value, in such a way that the resonator coil (1) is supported from at least one point by a supporting leg (6) of metal, which one end is fastened to the wire of the resonator coil (1) and the other end is fastened to an insulation piece (8) having low losses, which in turn is fastened to the installation plate.

16 Claims, 2 Drawing Sheets

SUPPORTING OF A HELIX RESONATOR

This is a continuation of international application Ser. No. PCT/FI91/00141, filed May 6, 1991.

FIELD OF THE INVENTION

The present invention concerns the supporting of a Helix resonator, with which the resonator's ability to withstand vibration is improved.

BACKGROUND OF THE INVENTION

The Helix resonator is generally used in filters operating in the frequency range of 100–1000 MHz. The resonator comprises an inner conductor, which is wound into a spiral coil, and the outer one is ,a metallic box that surrounds the former. One end of the coil can be connected directly to the box and in practice this is usually done by making the conductor, which is wound into the spiral coil, at this end straight for some distance and fixing it approximately perpendicular to-the end surface of the resonator box. The first round of the spiral coil is therefore situated at a distance from the end surface of the box, as defined by this straight leg. The opposite, open end of the coil is separate from the box and is capacitively coupled to the box. Electrically the resonator forms an LC-resonator circuit. The resonator can be connected electrically to the rest of a filter circuit by not connecting one end electrically to the box, but by instead connecting it with a connection lead which has been isolated from the box, or by attaching to a certain part of the Helix resonator coil a connection lead which goes insulated through the box wall. Mechanically the resonator coil can be of the vertical type i.e. the resonator coil is surrounded around the same axle by a metallic box which is earthed. The resonator coil is sometimes fastened on a support plate before it is inserted in the box. The position of the coil in relation to the support plate can be upright or lying down.

By connecting several resonators to cascade, it is possible to construct a filter with favourable characteristics, e.g. a duplex filter. The filter has to be designed so that the stop and passband characteristics do not change e.g. due to vibration occuring in mobile telephones. Because of this the Helix resonators of duplex filters must be supported mechanically in such a way that they cannot move.

One known way is to wind the loops of the coil around a cylindrical, hollowlike body of insulation material, which in turn is supported in various ways on the box construction. The disadvantage of this solution is that the body material in the electric and magnetic field of the coil lowers the Q value of the resonator.

Another known way to support the coil is that, after the coil has been wound, a plastic U-shaped binder ring is pressed around the loops of the coil. The loops of the coil run through the spaces in the binder ring and the part that connecting the arms is fastened to the installation plate. This way of supporting also lowers the Q value of the resonator, because the U-shaped ring used for supporting is in the middle of the electric and magnetic field of the resonator. The Q value is considerably lower compared to a resonator where no supporting means has been used in the electric and magnetic field. Another disadvantage is that the mould pressing of the plastic is a relatively complicated work procedure, where the variation in the amount of plastic in the binding is hard to control and may lead to rejects.

In the Finnish patent application number 884503, a Helix resonator is presented, in which a protruding part, preferably a curve, is formed on one of the resonator loops, this part resting against a small metallic folio strip on the circuit board. On the opposite side of the circuit board is another metallic folio strip, which is earthed. The strips and the material of the circuit board form a condensator, which acts as a simple temperature compensation for the resonator. The presented construction does support the resonator, but its disadvantage is the losses caused by the so called "excess" circuit board material, which occurs because the electrical field is in a lossy circuit board material at the supporting point.

SUMMARY OF THE INVENTION

This invention shows a way to support the Helix resonator, which does not have the disadvantages of the above described prior techniques and which supports the resonator coil mechanically and reliably to the installation plate. This is realised according to the invention by fastening the resonator coil from its protruding part to the surface of a small insulation piece while the opposite surface of the insulation piece is fastened to the installation plate.

The basic idea of the invention is to use a minimal sized insulation piece at the point of support, thus allowing for as large a part as possible of the electrical field between the resonator and the installation plate at the point of support to go through the air. This is advantageous as air is known to be a good insulator. As the mentioned electrical field is mainly in the air, the supporting of the resonator does not lower the Q value of the resonator significantly. In a preferred embodiment of the invention the coil is supported by using a separate supporting leg fastened to the coil, which supports the coil at one point on its outer surface and which, on its other end, is fastened to the insulation piece which in turn is fastened to the installation plate. The supporting leg can be of the same conductor that is used in the resonator coil itself. In another embodiment of the invention a bend, directed outwards, is made on one of the resonator loops and this bend is attached to the insulation piece.

BRIEF DESCRIPTION OF THE DRAWINGS

The invention is described in more detail referring to the disclosed drawings, in which.

DESCRIPTION OF ILLUSTRATIVE EMBODIMENTS

Figure 1:
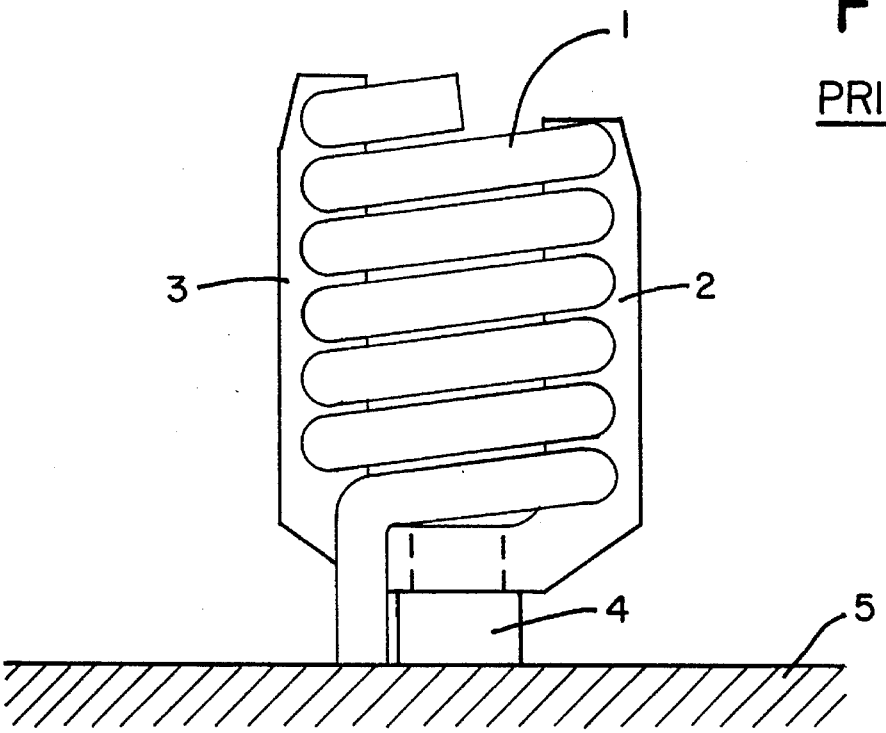
FIG. 1 PRIOR ART
FIG. 1 shows a supporting arrangement of a resonator coil according to the prior art.

FIG. 1 shows a prior art supporting in which a U-formed element of plastic material is used for supporting, the element is extruded into coil 1 in such a way that its loops run through legs 2 and 3 of the supporting element and the supporting element is fastened to the installation plate by the bridge part 4 which connects legs 2 and 3. In this way a mechanically strong construction can be achieved but the effect on the electrical properties of the resonator is harmful.

Figure 2:
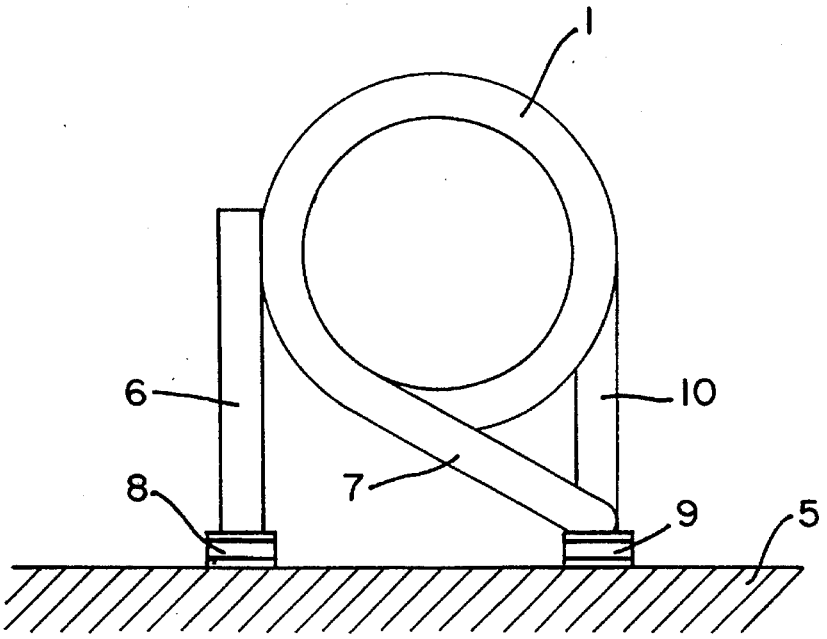
FIG. 2 shows the supporting arrangement according to the invention, seen in the direction of the coil axis.
Figure 3:
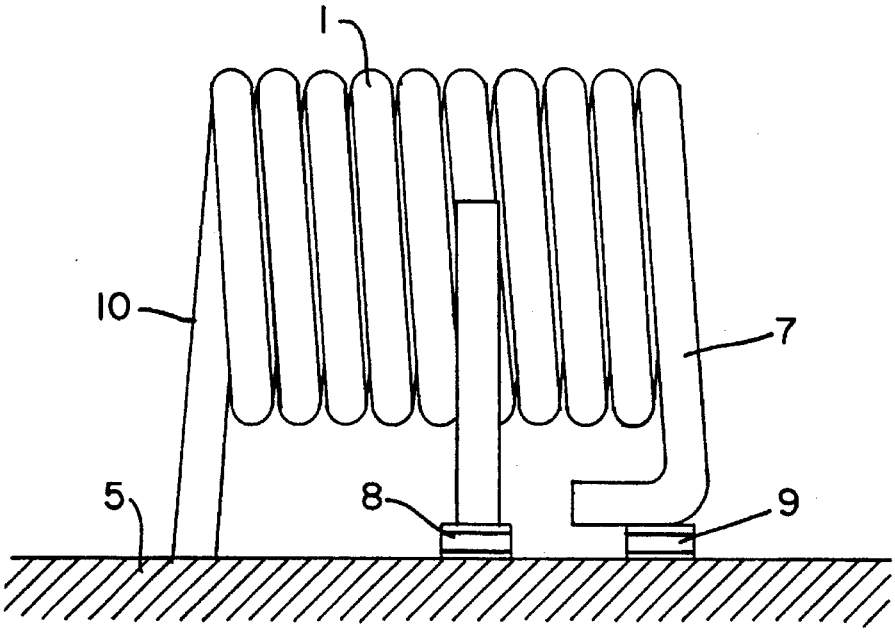
FIG. 3 is a side view of FIG. 2.

FIGS. 2 and 3 show the supporting according to the invention and the numerical references are the same as earlier. The supporting to the resonator coil 1 is done most conveniently by cold welding a metallic supporting leg 6. The supporting leg is advantageously made of the same material as the conduit material of coil 1 and it forms in fact part of the resonator coil. The figures show only one of these supporting legs and it is situated approximately in the middle of the resonator. Depending on the dimensions of the coil, the number and location of the supporting legs can naturally vary so that an optimal supporting is achieved. Between the supporting leg 6 and the installation plate 5 are pieces 8 and 9, which are made of low loss insulation material. The surfaces of the pieces which lie against the installation plate 5 and the end of the supporting leg 6 can be metallized, which makes it possible to cold weld them to the installation plate when the installation plate is metallized or of metallic material. But other ways of attachment may be used, e.g. crimping using clamp connections.

In the coil shown in FIGS. 2 and 3 the last loop of the resonator is made so that the end part 7 of the conduit extends outside of the coil cylinder and the tip of the end part can be bent in the direction of the installation plate 5, as can be seen in FIG. 3. The coil can be supported from this tip part by placing between it and the installation plate 5 an insulation piece 9, like the piece 8 between the leg 6 and the installation plate and with the same way of fastening.

The "leg" of the resonator has been designated by the number 10. From this leg the high-frequency signal is brought insulated from the installation plate and the resonator box (not shown) to the resonator coil 1. The tip of the leg 10 can also be cold welded to the resonator box, in which case the signal is tapped via a connection lead to a suitable place on the coil 1. Any known methods may be used and they do not in any way limit this invention. In any case, the leg 10 is fastened directly or insulated to the installation plate and the fastening also serves as an additional supporting for the coil. The installation plate 5 can be a printed circuit board of which at least one continuous metallic foil forms one surface of the resonator box, or it can be a metal plate which forms one wall of the completed resonator. The construction in FIGS. 2 and 3 is finally surrounded with a metal box, either completely or so that the installation plate 5 forms one wall of the box. The various solutions are evident to persons skilled in the art.

Figure 4:
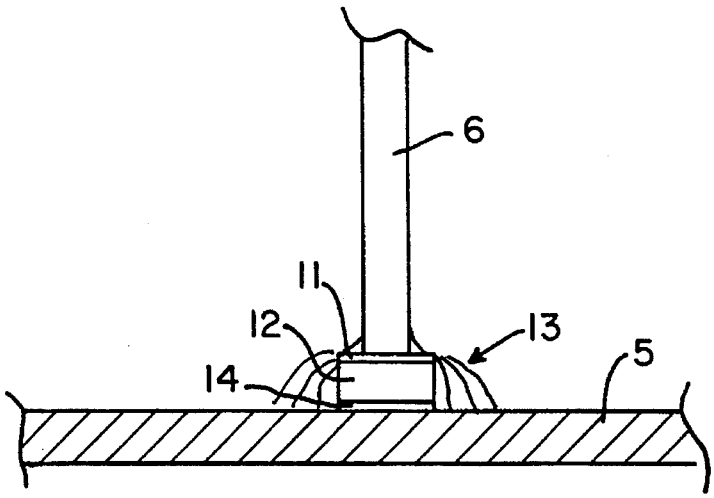
FIG. 4 shows the electrical field at the insulation piece situated at the point of support.

FIG. 4 shows clearly how, by using in accordance with the invention a minimally small insulation piece 13 between the supporting leg 6 and the metallic installation plate 5, a large portion of the electrical field 13 can be led through the air with only a small portion going through the insulation piece 12. The electrical field 13 is shown by continuous lines. In this figure as well as in FIGS. 2 and 3, the insulation piece has a thin layer 11 and 14 on those surfaces that come in contact with the supporting leg and the installation plate. The layer makes fastening by cold welding easier and directs the electrical field at the root of the leg towards the above lying air space. As a large portion of the electrical field goes through the well insulating air and not through the lossy insulating material 12, a supporting which affects the resonator Q value only slightly can be achieved.

The size of the insulation piece 8 and 9 used in the supporting is as small as possible in the direction of the surface 5. Preferably it is round-shaped and in the direction of the surface 5 it has a diameter which is approximately the same as the diameter of the wire used as supporting leg 6. In practice the surface area of the insulation piece in the direction mentioned is slightly larger than the cross-section of the wire in order to achieve a sufficient mechanical strength. The surface form is thus preferably round, but can also be square shaped, a rectangle or of some other form. The height of the piece has to be enough to achieve a sufficient mechanical strength. On the other hand it can be said that, the better the insulating material of the piece is, the smaller the height needs to be.

The supporting arrangement according to the invention forms a mechanically strong resonator construction. By minimizing the insulation material by which the resonator is supported to a small insulation piece, its harmful effects can also be minimized. The supporting leg 6, shown in FIGS. 3 and 4, is straight, but it can be naturally arched or of some other desired form. The supporting can be also achieved by using the extension of the conduit of the resonator coil as an aid, as the extension 7 has been used in FIGS. 3 and 4. Alternatively the protruding part can be formed in such a way that an outwards protruding bend from the surface of the resonator coil is made on one of the loops on the resonator coil. The top of the bend extends close to the surface of the installation plate, and an insulation piece according to the invention has been placed between the top and the installation plate. The insulation piece is fastened between the top of the bend and the installation plate.

The insulation piece can be of any low conducting and mechanically sufficiently strong material. For its fastening to the installation plate and the supporting leg any known and reliable method may be used, such as crimping, pressure moulding, gluing etc. The insulation piece may also be made of a low lossy circuit board. In order to achieve the substantial improvement of the resonator Q value in accordance with the main idea of the invention, the circuit board has to be cut to the same size as the metallic foil on its surface to which the supporting leg of the resonator is fastened.

I claim:

1. A supporting arrangement for a Helix resonator of a type having a resonator coil defining an axis therethrough, where the resonator coil is spaced from an installation plate and the axis of the coil is mainly parallel with the surface of the plate and at least one loop of the coil is provided with a protruding part wherein the resonator coil is fastened from the protruding part to a surface of a small insulation piece and an opposite surface of the insulation piece is fastened to the installation plate.

2. A supporting arrangement according to claim 1, characterized in that the surface area of the insulation piece in the direction of the surface of the installation plate is the same or only slightly larger than the surface area of the part of the insulation piece to which the protruding part of the resonator is supported.

3. A supporting arrangement according to claim 1, characterized in that the surface of the insulation piece that is directed away from the installation plate is of conducting material.

4. A supporting arrangement according to claim 3, characterized in that the surface of the insulation piece that is directed towards the installation plate is of conducting material.

5. A supporting arrangement according to claim 2, characterized in that the insulation piece is fastened to the resonator and the installation piece by pressure moulding.

6. A supporting arrangement according to claim 3, wherein in that the insulation piece is a piece cut out from a circuit board.

7. A supporting arrangement according to claim 1, wherein in that the protruding part is a supporting leg of metal, one end of which is fastened to the wire of the resonator coil and the other end is fastened to the insulation piece.

8. A supporting arrangement according to claim 1, wherein in that the installation plate forms one wall of the resonator box.

9. A supporting arrangement according to claim 4, wherein in that the insulation piece is a piece cut out from a circuit board.

10. A supporting arrangement according to claim 2, wherein in that the protruding part is a supporting leg of metal, one end of which is fastened to the wire of the resonator coil and the other end is fastened to the insulation piece.

11. A supporting arrangement according to claim 2, wherein in that the installation plate forms one wall of the resonator box.

12. A supporting device for a helix resonator of a type having a resonator coil with a plurality of turns and at least one leg portion for providing connection to an installation plate surface, the resonator coil defining an axis therethrough, the supporting device comprising:

a separate supporting member extending from the installation plate surface wherein a portion of the supporting member is connected to an outside surface of at least one of the plurality of turns of the resonator coil, such that the plurality of turns of the resonator coil are spaced apart from the installation plate surface.

13. A supporting device for a helix resonator as recited in claim 12, wherein the supporting member is connected to the resonator coil such that the axis of the resonator coil is substantially parallel with the installation plate surface.

14. A supporting device for a helix resonator as recited in claim 12, wherein the supporting device further includes an insulation member connecting the supporting member to the installation plate surface.

15. A supporting device for a helix resonator as recited in claim 14, wherein the insulation member includes first and second insulation layers spaced apart by a lossy insulation material with the first insulation layer being coupled a portion of the supporting member and the second insulation layer being coupled to the installation plate surface.

16. A supporting device for a helix resonator as recited in claim 12, wherein the supporting member is fabricated from a conductive material.

* * * * *